United States Patent [19]

Embury, Jr. et al.

[11] Patent Number: 4,726,295

[45] Date of Patent: Feb. 23, 1988

[54] GRENADE ARRANGEMENT FOR SCREENING CLOUD

[75] Inventors: Janon F. Embury, Jr., Baltimore; Leonard R. Sellman, Linthicum; Werner W. Beyth, Baltimore; Raymond R. Fry, Jr., Joppa; Merlin L. Erickson, Perryman; Leon R. Milstead, Timonium; Laban R. Lowe, White Hall; David M. Scheve, Baltimore; Robert W. Schnepfe, Jr., Upperco, all of Md.

[73] Assignee: AAI Corporation, Hunt Valley, Md.

[21] Appl. No.: 863,767

[22] Filed: May 16, 1986

[51] Int. Cl.[4] ..... F42B 13/44

[52] U.S. Cl. ..... 102/334; 102/482; 102/505

[58] Field of Search ..... 102/334, 482, 505

[56] References Cited

U.S. PATENT DOCUMENTS

| | | | |
|---|---|---|---|
| 3,883,942 | 5/1975 | Fichter, Jr. et al. | 102/334 X |
| 4,210,555 | 7/1980 | Lubbers et al. | 102/334 X |
| 4,406,227 | 9/1983 | Beeker et al. | 102/505 |
| 4,435,233 | 3/1984 | Rayer et al. | 102/334 |
| 4,438,700 | 3/1984 | Knapp | 102/334 |
| 4,446,794 | 5/1984 | Simmons | 102/334 X |
| 4,534,810 | 8/1985 | Knapp | 102/334 X |

*Primary Examiner*—Peter A. Nelson

*Attorney, Agent, or Firm*—Reginald F. Pippin, Jr.

[57] ABSTRACT

A grenade arrangement for forming a visual and infrared screening cloud, having a frangible body, a hollow cylindrical solid compact cohesive mass of compacted generally mutually adhered fine metal flakes of a copper composition, particularly brass, and of submicron thickness and multimicron in lateral dimensions, a cylindrical mass of HE explosive within such hollow cylindrical mass for aerosoling such metal flakes into the atmosphere, and having HE explosive percussisvely activating detonator means, a launch propulsion charge and pyrotechnic delay means between the propulsion charge and the HE explosive detonator.

25 Claims, 5 Drawing Figures

GRENADE ARRANGEMENT FOR SCREENING CLOUD

The U.S. Government has a paid-up license in this invention and the right in limited circumstances to require the patent owner to license others on resonable terms as provided for by the terms of Contract Number DAAK11-79-C-0123 awarded by Department of the Army.

This invention relates to a grenade arrangement for forming a visual and infrared screening cloud in the atmosphere at a desired spatial location.

Efforts to develop a screening cloud that will protect military equipment from both visual and infrared detection have been underway for a number of years. Various military vehicles are conventionally equipped with smoke grenades and suitable launchers, such as launching tubes or barrels, singly or in clusters, whereby the grenades are launched to provide a visual screen relative to the vehicle.

It is an object of the present invention to provide a volume-limited grenade arrangement enabling dissemination of visual and infrared screening compositions in a manner compatible with current vehicle-mounted smoke grenade launcher systems, so as to form an effective infrared and visual screening cloud.

Screening effectiveness is optimized by providing a spatially launchable grenade or projectile having an HE explosive central burster surrounded by a volume-limited densely compacted special metal flake composition, compatible with HE explosive, for bursting in any desired spatial position and which may be launched from a conventional launch tube.

A further object is the provision of a grenade which may be constructed of standard tube-launchable volume-limited shape and size and which enables the selected spatially positioned formation of a visual and infrared screening cloud of substantial effectiveness.

Still other objects, features and attendant advantages will become apparent from a reading of the following detailed description of an illustrative embodiment and mode of practice of the inventio, taken in conjunction with the accompanying Figures of the Drawings, wherein.

Referring now in detail to the Figures of the Drawings, a visual and infrared screening cloud SC is formed in the atmosphere by projecting one or more burstable containers, such as grenades 21, into the atmosphere at the desired location for formation of a screening cloud SC. This may be effected by launching grenades 21 from a screening vehicle, as by use of conventional multiple launch tubes LT in a launcher L mounted on the vehicle.

The screening cloud SC is formed of fine metal flakes F of a copper composition, in which the flakes F are of submicron thickness and multimicron lateral face dimensions. It has been found that copper alloys, such as bronze and brass, provide an effective visual and infrared screening cloud SC, and that an effective aerosoling of such flakes may be accomplished by using copper alloy, particularly brass, flakes generally of a size of the order of approximately 1.5–14 microns in lateral face dimensions of length, width, diameter or the like, and of the order of approximately 0.07–0.27 microns in thickness.

Metal flakes F of copper composition, particularly copper alloys and preferably brass, which are employed as pigments in the printing industry, have been found to be highly suitable for practice of this invention.

These metal flakes F are suitably compacted as by wetting and subsequently drying a desired mass of such flakes F, to form a compact generally cohesive mass of flakes CF, in a configuration which enables ready explosive bursting to effect aerosoling of the flakes in the atmosphere to thereby form the desired screening cloud SC.

Figure 1:
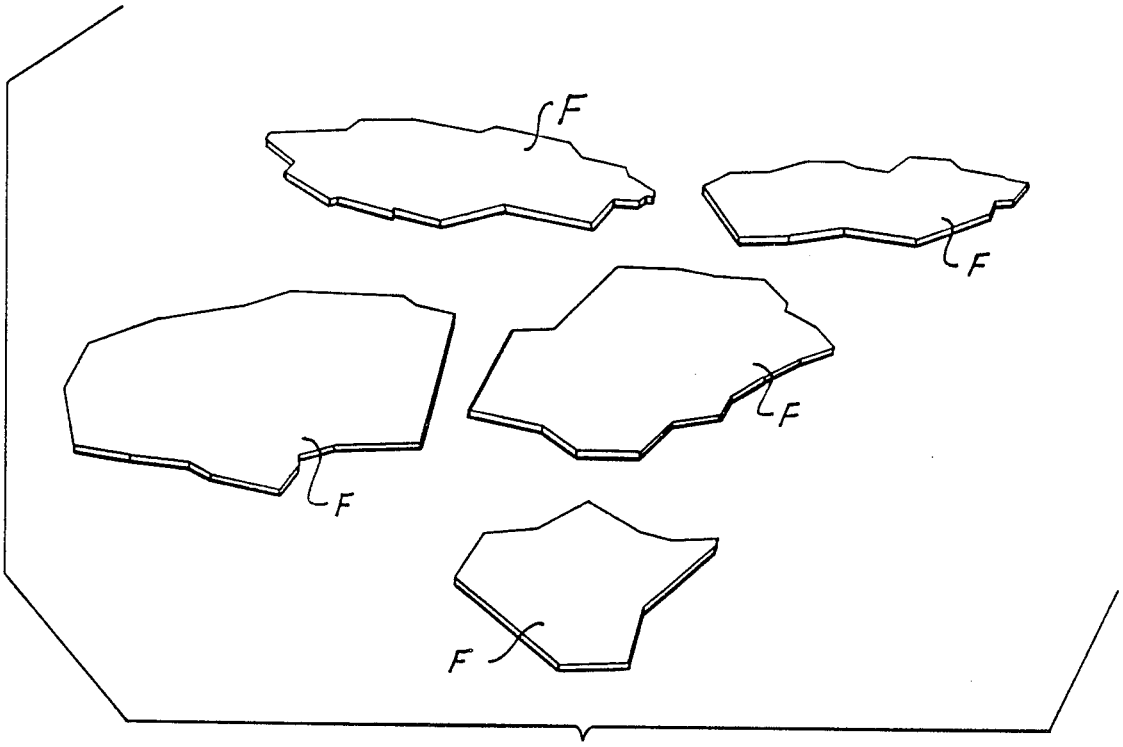
FIG. 1 is a view in perspective of typical random configurations of special flakes employed in the invention.
Figure 2:
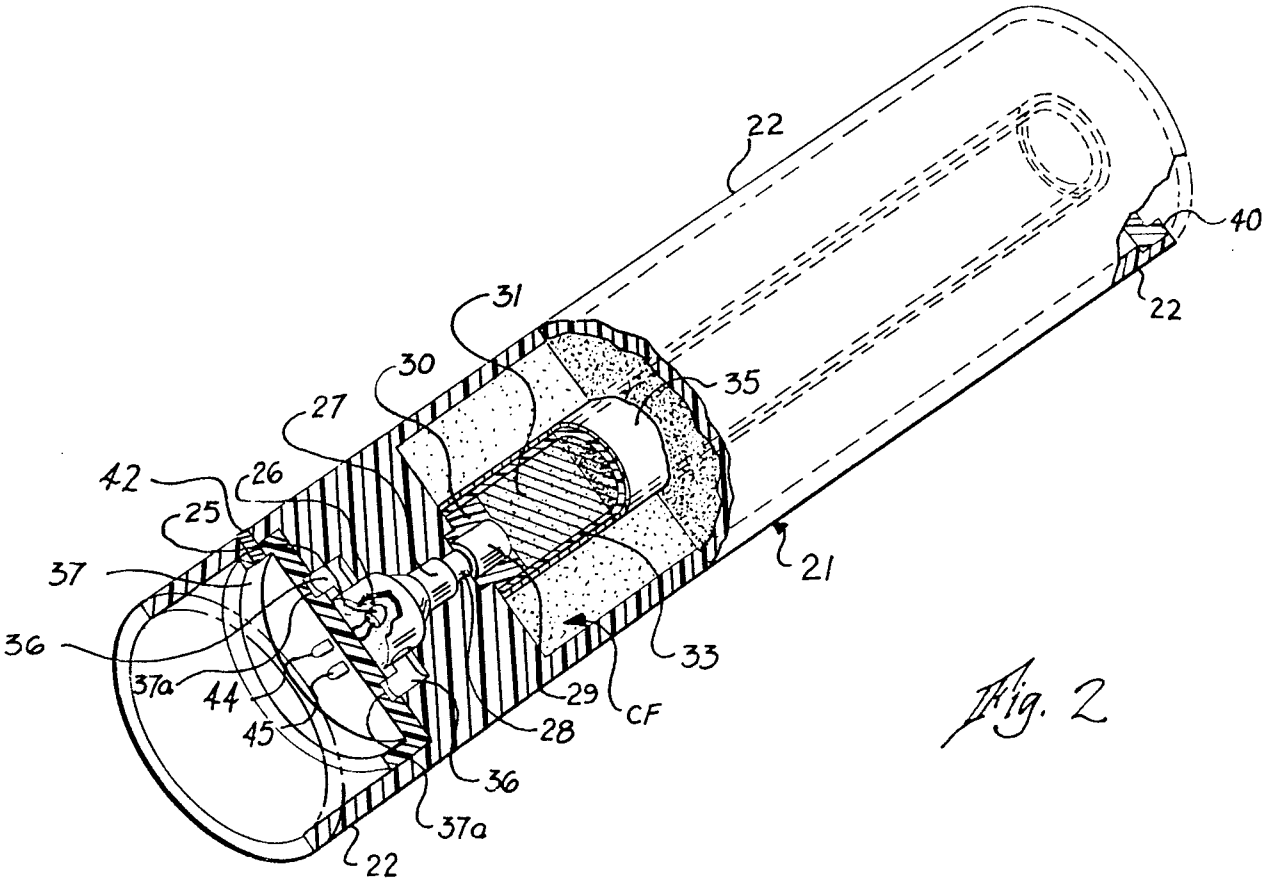
FIG. 2 illustrates, in partial cut-away, a grenade arrangement embodying the invention.

It has been found that a hollow cylindrical or tubular shape is a desirable configuration to enable both adequate bursting of the compact flake mass CF, and also to enable its use in a suitably launchable grenade form as shown at 21 in FIG. 2.

In forming the visual and infrared screening cloud SC, the compacted hollow cylindrical mass of copper alloy flakes CF is explosively burst in the atmosphere by an HE explosive charge mass 31 which is disposed within the hollow cylindrical compacted mass of flakes CF. The term HE explosive is generally accepted as being a composition whose consumption rate is 20,000 feet per second or more.

A ratio of the weight of the compacted mass of metal flakes CF relative to the HE explosive charge mass 31 may be employed within the general range of approximately 20:1 to 60:1, with an optimum ratio being approximately 40:1, particularly for brass flakes CF. This yields maximum visual and infrared screening attenuation over an adequate area to screen the source vehicle SV and surrounding personnel or vehicles from enemy vehicles EV and enemy personnel EP, consistent with grenade volume constraints imposed by launching from a launch tube of desired conventional relatively small size.

A particular advantage of the copper flake composition, particularly copper alloy and preferably brass for the compacted metal flakes CF, is the ability of these flakes to provide a highly effective visual and infrared screening cloud while not flashig or igniting as a result of the explosive bursting of the compact mass CF by the HE explosive 31.

It has been found that clouds of 7 to 10 meters in diameter may be readily formed according to the invention with excellent attenuation throughout the visible and infrared wavelength regions.

Figure 2A:
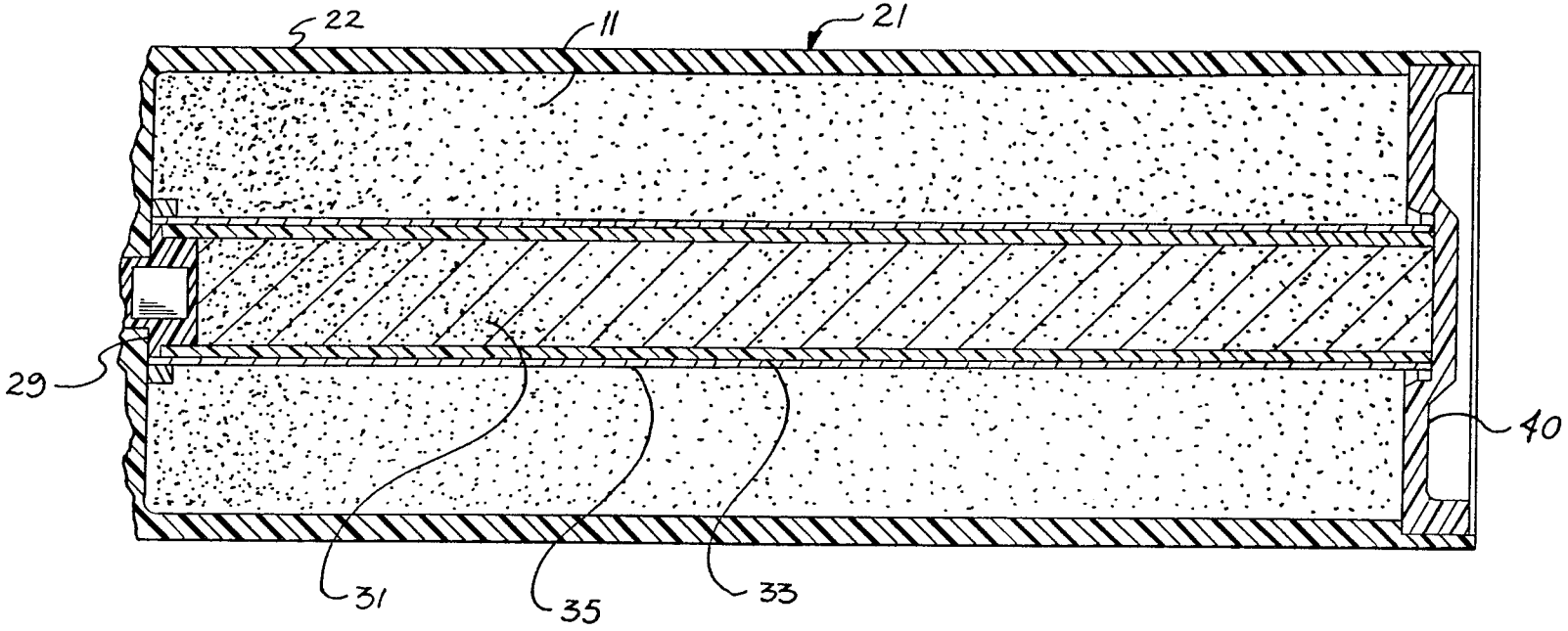
FIG. 2A is a longitudinal section view of the front end section of the grenade of FIG. 2.
Figure 3:
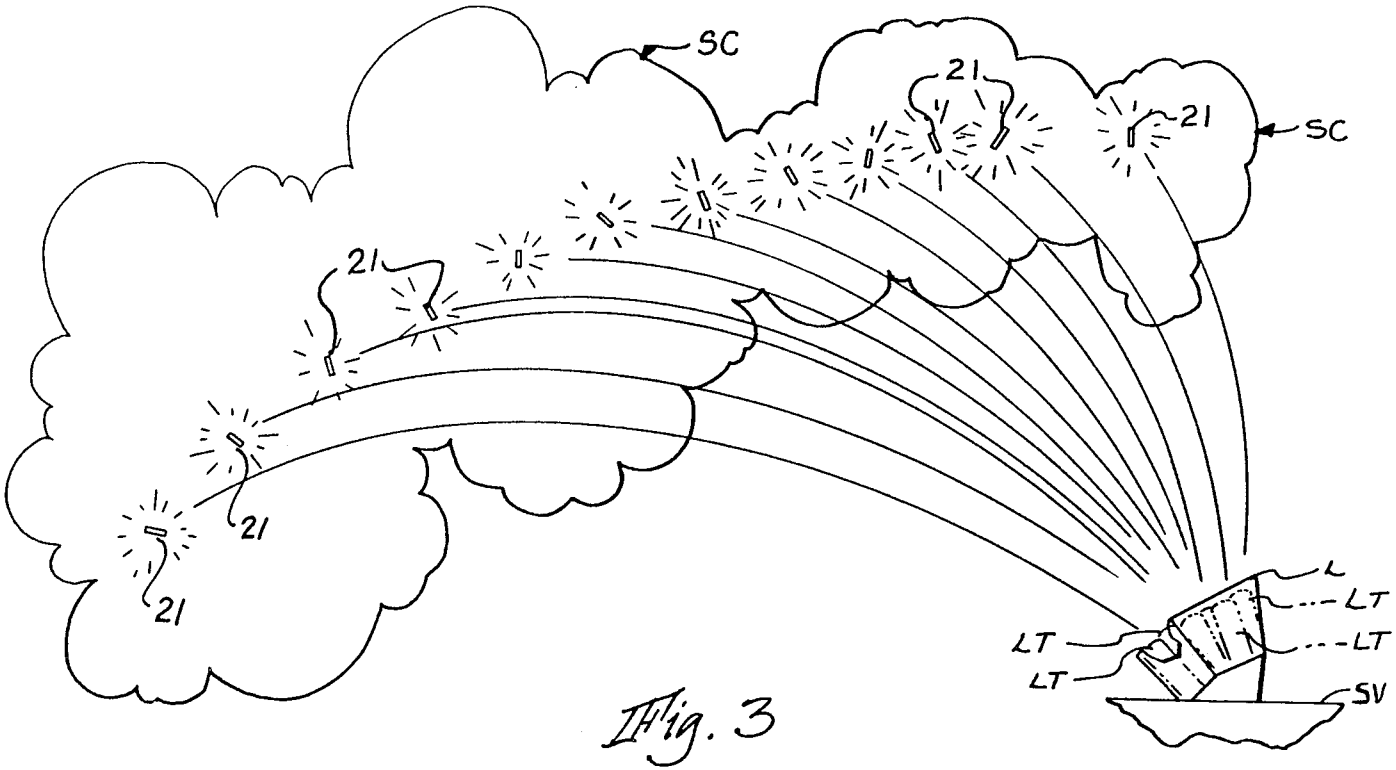
FIGS. 3 and 4 illustrate the forming of multiple screening clouds to form a composite screening cloud with multiple grenades according to the invention.
Figure 4:
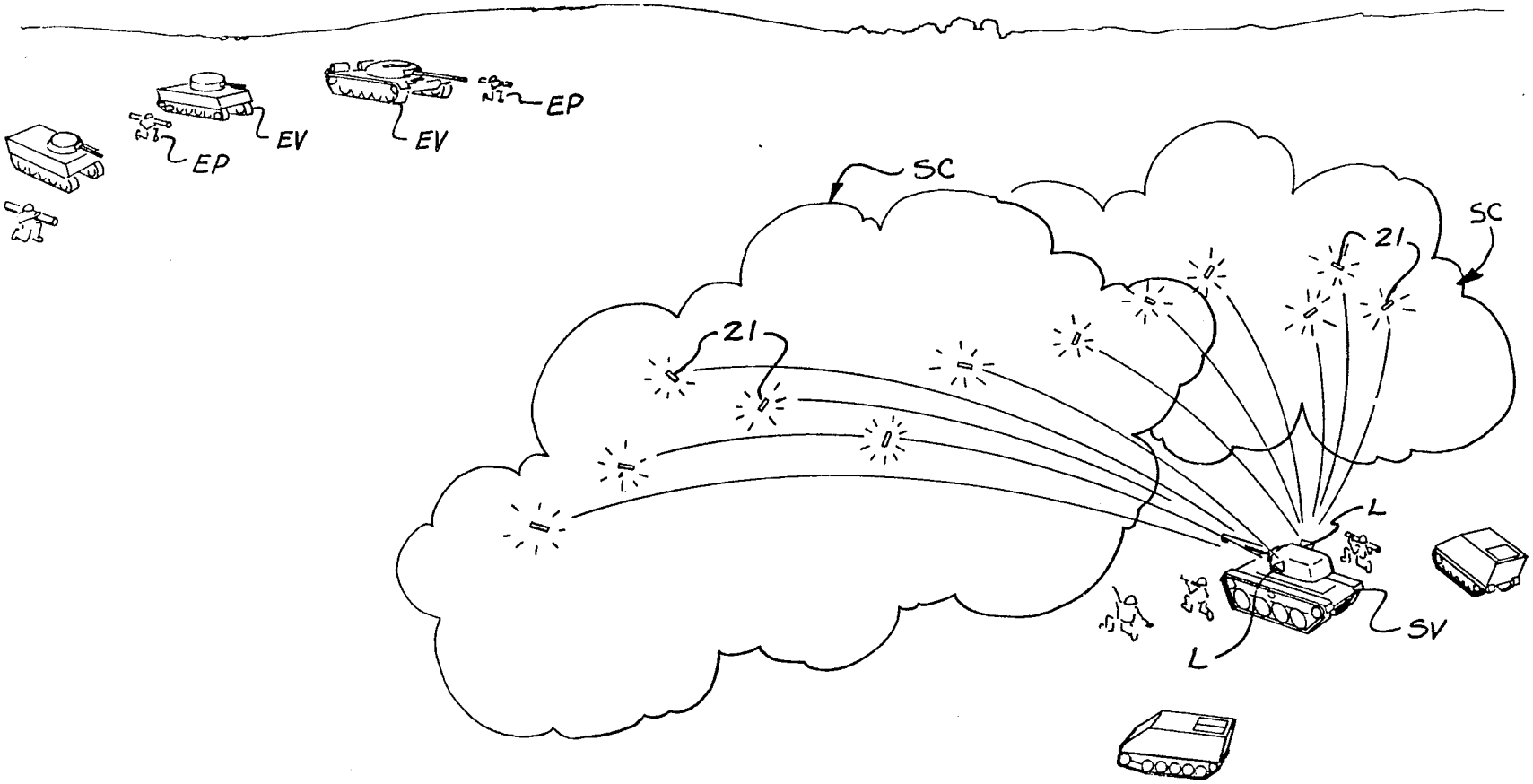

A suitable grenade arrangement according to the present invention, for spatially positioning a hollow cylindrical mass CF of compact selected copper composition fine metal flake and a corresponding elongate explosive burster mass 31 of HE explosive for explosively aerosoling the metal flakes F and enabling the forming of an effective visual and infrared screening cloud SC, is generally shown in FIGS. 2 and 2A. In this arrangement, a self-propelled grenade 21 is provided, which is launchable from a conventional launch tube LT (FIG. 3) mounted on a vehicle or otherwise as desired.

Grenade 21 has a frangible plastic body 22 within which is a hollow cylinder or tube of compacted metal flakes of copper composition CF as previously described. Within the hollow cyolindrical mass of metal flakes CF is a cylinder of HE explosive 31, which may be of any conventional HE composition. A guide tube 35 and support tube 33 may be employed between the hollow cylindrical mass CF and the cylindrical HE mass 31, with a plastic cover 40 suitably secured over the end thereof, as by ultrasonic welding.

The grenade is self-propelled by a propellant charge 26 which may be ignited as by an electric squib or electric match 25 and electrical connectors 44, 45, with propellant gases venting rearwardly through side vents 36 leading from the propellant chamber and out through thin-walled blow-outs 37*a* formed in propellant cover 37, which may be suitably secured in place in body 22, as by ultrasonic welding and/or mechanical connections such as a pin or pins 42.

A suitable pyrotechnic delay 27 may be ignited directly by the burning propellant 26, immediately connecting therewith, to enable a desired time delay after launch before burst of the HE charge 31.

One or more percussive detonators 28, 29, which may be of successively increasing power, may be employed in the ignition/detonation path leading to the HE mass 31. In the illustrated embodiment, an ignitable relatively low power detonator 28 activates a higher power booster lead 29, which in turn effects explosion of the HE explosive mass 31, to thereby effectively break up and aerosol the fine metal flake mass CF and thus form a desired visual and infrared screening cloud in the atmosphere and the desired location.

By launching multiple grenades 21 from launchers L over a desired are, it will be appreciated that a screening cloud of desired size may be formed so as to screen a relatively wide area from enemy vehicles EV and enemy personnel EP.

While the invention has been illustrated and described with respect to a single illustrative embodiment, it will be appreciated that various modifications and improvements may be made without departing from the scope and spirit of the invention. Accordingly, the invention is not to be limited by the particular illustrative embodiment, but only by the scope of the appended claims.

We claim:

1. A grenade arrangement for forming a visual and infrared screening cloud, comprising a frangible elongate body, a hollow elongate substantially solid compact cohesive mass of compacted generally mutually adhered fine metal flakes of a copper composition which may be burst apart under high explosive force, and being disposed within said body, an elongate explosive mass of HE explosive disposed within and extending along the length of said hollow elongate mass, detonator means for percussively effecting explosion of said elongate mass of HE explosive, and being carried by said body, pyrotechnic time delay means carried by such body and operatively connecting with said detonator means for activation of said detonator means at a predetermined time after activation of said pyrotechnic time delay means, and ignition means for said pyrotechnic time delay means.

2. An arrangement according to claim 1, further comprising a propellant charge carried by said body at one end thereof for self-propulsion of said body into the atmosphere for subsequent explosive dissemination of said flakes as an aerosol cloud in the atmosphere, and means for igniting said propellant charge, said ignition means for said pyrotechnic time delay means comprising said propellant charge.

3. An arrangement according to claim 2, said means for igniting said propellant charge comprising an electric squib, and electric connectors connecting with said squib.

4. An arrangement according to claim 1, said flakes being of submicron thickness and substantially greater in lateral dimensions than thickness.

5. An arrangement according to claim 4, said flakes being of random size and a size generally of the order of approximately 1.5–14 microns in lateral face dimensions of length, width, diamter or the like, and generally of the order of approximately 0.07–0.27 microns in thickness.

6. An arrangement according to claim 5, said flakes being generally oblong and random in size and shape.

7. An arrangement according to claim 5, said flakes being formed of a copper alloy.

8. An arrangement according to claim 7, said flakes being formed of brass.

9. An arrangement according to claim 8, the ratio of the weight of said final metal flake solid compact mass of compacted generally mutually adhered metal flakes relative to the weight of said HE explosive charge being within the range of approximately 20:1–60:1.

10. An arrangement according to claim 9, said ratio being approximately 40:1.

11. An arrangement according to claim 1, further comprising a frangible guide tube extending between said hollow elongate mass of compacted metal flakes and said elongate mass of HE explosive.

12. An arrangement according to claim 11, further comprising a frangible support tube for said elongate explosive mass of HE explosive and which support tube is carried by and within said body.

13. An arrangement according to claim 12, said detonator means for percussively effecting explosion of said elongate mass of HE explosive being disposed adjacent one end of said elongate mass of HE explosive and being carried by said body.

14. An arrangement according to claim 13, a propellant charge carried by said body at one end thereof for self-propulsion of said body into the atmosphere for subsequent explosive dissemination of said flakes as an aerosol cloud in the atmosphere, and means for igniting said propellant charge, said ignition means for said pyrotechnic time delay means comprising said propellant charge, said means for igniting said propellant charge comprising an electric squib, and electric connectors connecting with said squib.

15. An arrangement according to claim 14, said flakes being of submicron thickness and substantially greater in lateral dimension than thickness.

16. An arrangement according to claim 15, said flakes being of random size and a size generally of the order of approximately 1.5–14 microns in lateral face dimensions of length, width, diamter, or the like, and generally of the order of approximately 0.07–0.27 microns in thickness.

17. An arrangement according to claim 16, said flakes being generally oblong and random is size and shape.

18. An arrangement according to claim 17, said flakes being formed of a copper alloy.

19. An arrangement according to claim 18, said flakes being formed of brass.

20. An arrangement according to claim 19, the ratio of the weight of said final metal flake solid compact mass of compacted generally mutually adhered metal flakes relative to the weight of said HE explosive charge being within the range of approximately 20:1–60:1.

21. An arrangement according to claim 20, a frangible guide tube extending between said hollow elongate mass of compacted metal flakes and said elongate mass of HE explosive.

22. An arrangement according to claim 21, a frangible lsupport tube for said elongate explosive mass of HE explosive and which support tube is carried by and within said body.

23. An arrangement according to claim 22, said detonator means for percussively effecting explosion of said elongate mass of HE explosive being disposed adjacent one end of said elongate mass of HE explosive and being carried by said body.

24. An arrangement according to claim 23, a propellant charge carried by said body at one end thereof for self-propulsion of said body into the atmosphere for subsequent explosive dissemination of said flakes as an aerosol cloud in the atmosphere, and means for igniting said propellant charge, said ignition means for said pyrotechnic time delay means comprising said propellant charge.

25. An arrangement according to claim 24, said means for igniting said propellant charge comprising an electric squib, and electric connectors connecting with said squib.

* * * * *